US007854642B2

(12) United States Patent
Nelson et al.

(10) Patent No.: US 7,854,642 B2
(45) Date of Patent: Dec. 21, 2010

(54) BALLOON DISPLAY SIMULATING MOTIONS OF A LIGHTER-THAN-AIR BALLOON

(76) Inventors: David C. Nelson, P.O. Box 352, Sharon Center, OH (US) 44274-0352; Wesley A. Schroeder, 9011 Guilford Rd., Seville, OH (US) 44273

( * ) Notice: Subject to any disclaimer, the term of this patent is extended or adjusted under 35 U.S.C. 154(b) by 199 days.

(21) Appl. No.: 12/012,185

(22) Filed: Jan. 31, 2008

(65) Prior Publication Data

US 2009/0197502 A1 Aug. 6, 2009

(51) Int. Cl.
*A63H 3/06* (2006.01)

(52) U.S. Cl. ..... 446/220; 446/221; 446/222; 446/223; 446/224; 446/225; 446/226; 446/227; 446/228; 446/77; 446/489; 446/315; 446/268; 446/397; 248/309.1; 248/565; D21/439; D21/440

(58) Field of Classification Search ..... 446/220–228, 446/77, 489, 315, 268, 397; 248/309.1, 565; D21/439, 440
See application file for complete search history.

(56) References Cited

U.S. PATENT DOCUMENTS 583,306 A * 5/1897 Hesse ..... 446/220
1,229,794 A * 6/1917 Salzer ..... 362/253
1,787,159 A * 12/1930 Merritt ..... 446/220
2,312,369 A * 3/1943 Solecki ..... 446/220
2,383,390 A * 8/1945 Jacobs ..... 40/214
2,664,667 A * 1/1954 Burroughs ..... 446/222
2,840,948 A * 7/1958 Stickley ..... 446/223
2,882,645 A * 4/1959 Stivers ..... 446/220
2,931,133 A * 4/1960 Dodson ..... 446/222
2,991,970 A * 7/1961 White et al. ..... 248/565
2,996,834 A * 8/1961 Berlow ..... 446/220
3,094,807 A * 6/1963 Dorman ..... 446/222
3,250,241 A * 5/1966 Levy et al. ..... 116/63 R
3,267,604 A * 8/1966 Goldsmith ..... 446/222
3,348,796 A * 10/1967 Baratoff et al. ..... 248/565
3,411,778 A * 11/1968 Barry ..... 273/365
3,563,676 A * 2/1971 Coovert ..... 417/410.1
3,616,569 A * 11/1971 Litt et al. ..... 446/220
3,941,384 A * 3/1976 Wopschall ..... 273/386
4,030,237 A * 6/1977 Lewis ..... 446/213
4,142,322 A * 3/1979 Zeyra ..... 446/224

(Continued)

FOREIGN PATENT DOCUMENTS

GB 225131 A1 11/1924

*Primary Examiner*—Gene Kim
*Assistant Examiner*—Alexander R Niconovich
(74) *Attorney, Agent, or Firm*—Renner, Kenner, Greive, Bobak, Taylor & Weber

(57) ABSTRACT

A balloon display that simulates motions of a lighter-than-air balloon includes a balloon holder and an inflated balloon. The balloon holder includes a neck fastening assembly, and the inflated balloon is secured to the balloon holder by the neck fastening assembly. A compression spring balloon support extends upwardly relative to the neck fastening assembly to support a majority of the inflated balloon above the neck fastening assembly. The inflated balloon is secured to the neck fastening assembly and supported by the compression spring balloon support such that the balloon slightly loads the compression spring balloon support and the balloon tends to move up and down, side to side, and front to back as the compression spring balloon support reacts to the load of the balloon.

7 Claims, 3 Drawing Sheets

U.S. PATENT DOCUMENTS 4,145,838 A * 3/1979 Mason ..... 446/77
4,165,770 A * 8/1979 Goldman et al. ..... 141/329
4,292,999 A * 10/1981 Szollmann ..... 137/560
4,499,763 A * 2/1985 Varkia ..... 73/170.28
4,589,854 A * 5/1986 Smith ..... 446/223
4,661,081 A * 4/1987 Basseches ..... 446/220
4,715,841 A * 12/1987 Nelson et al. ..... 446/222
4,729,749 A * 3/1988 Milne ..... 446/222
4,737,133 A * 4/1988 Neumeier ..... 446/397
4,778,431 A * 10/1988 Dudley ..... 446/221
4,794,498 A * 12/1988 Neumeier ..... 362/186
4,798,554 A * 1/1989 Nelson et al. ..... 446/222
4,881,916 A * 11/1989 Houser ..... 446/222
4,895,545 A * 1/1990 Nelson ..... 446/220
4,920,674 A * 5/1990 Shaeffer ..... 40/412
4,997,403 A * 3/1991 Akman ..... 446/220
5,021,022 A * 6/1991 Ganz ..... 446/220
5,083,250 A * 1/1992 Malcolm ..... 362/253
D329,261 S * 9/1992 Pollack ..... D21/440
5,203,530 A * 4/1993 Liu ..... 248/309.1
RE34,401 E * 10/1993 Dudley ..... 446/221
5,259,805 A * 11/1993 Kieves ..... 446/220
5,295,891 A * 3/1994 Schalk ..... 446/222
5,312,286 A * 5/1994 Domen ..... 446/187
5,335,689 A * 8/1994 Reittu ..... 137/231
5,395,276 A * 3/1995 Valentino ..... 446/217
D360,844 S * 8/1995 Miller et al. ..... D10/110
5,444,607 A * 8/1995 Dreyfuss ..... 362/352
5,531,401 A * 7/1996 Newcomb ..... 244/31
5,547,413 A * 8/1996 Murray ..... 446/220
5,588,897 A * 12/1996 Valentino ..... 446/217
5,683,167 A * 11/1997 Tarlow ..... 362/96
5,944,576 A * 8/1999 Nelson et al. ..... 446/220
6,007,403 A * 12/1999 Urspringer et al. ..... 446/222
6,142,415 A * 11/2000 Ambrico ..... 244/33
6,146,001 A * 11/2000 Cwiakala ..... 362/267
6,165,039 A * 12/2000 Cobane ..... 446/220
6,176,758 B1 * 1/2001 Wu ..... 446/224
D439,283 S * 3/2001 Naranjo ..... D21/440
6,375,534 B1 * 4/2002 Burns ..... 446/220
6,390,651 B2 * 5/2002 Bertrand ..... 362/352
6,422,914 B1 * 7/2002 Nelson et al. ..... 446/220
6,430,804 B1 * 8/2002 Nelson et al. ..... 29/566
6,478,651 B1 * 11/2002 Weir ..... 446/220
6,511,359 B1 * 1/2003 Lui ..... 446/321
6,527,615 B1 * 3/2003 Boehler ..... 446/220
6,575,806 B1 * 6/2003 Nelson et al. ..... 446/222
6,622,759 B2 * 9/2003 Yang ..... 141/114
6,631,811 B2 * 10/2003 Komar et al. ..... 211/13.1
6,699,095 B1 * 3/2004 Epstein ..... 446/222
6,730,005 B1 * 5/2004 Liao ..... 482/142
6,739,725 B2 * 5/2004 Ben-Ari ..... 353/28
6,790,120 B1 * 9/2004 Murray ..... 446/220
6,969,295 B1 * 11/2005 Sidwell ..... 446/220
D517,123 S * 3/2006 Sidwell ..... D20/42
D529,102 S * 9/2006 Sidwell ..... D21/453
7,147,536 B1 * 12/2006 Hartelius ..... 446/220
7,204,740 B2 * 4/2007 Petell ..... 446/220
7,318,765 B1 * 1/2008 Hartelius ..... 446/220
7,320,529 B2 * 1/2008 Goh et al. ..... 362/96
7,322,073 B2 * 1/2008 Cuisinier ..... 24/30.5 S
7,588,477 B2 * 9/2009 Sidwell ..... 446/224
RE41,056 E * 12/2009 Sidwell ..... D21/453
2004/0198146 A1 * 10/2004 Murray et al. ..... 446/220
2005/0210639 A1 * 9/2005 Cuisinier ..... 24/455
2006/0039138 A1 * 2/2006 Oxborrow ..... 362/189
2006/0292959 A1 * 12/2006 Greenwald et al. ..... 446/220
2006/0292960 A1 * 12/2006 Muller ..... 446/220
2007/0049158 A1 * 3/2007 Chou ..... 446/220
2007/0167107 A1 * 7/2007 Petell et al. ..... 446/220
2007/0249259 A1 * 10/2007 Pham ..... 446/224
2008/0057825 A1 * 3/2008 Nelson et al. ..... 446/220
2008/0076322 A1 * 3/2008 Phillips ..... 446/220
2009/0183328 A1 * 7/2009 King ..... 15/143.1

* cited by examiner

BALLOON DISPLAY SIMULATING MOTIONS OF A LIGHTER-THAN-AIR BALLOON

TECHNICAL FIELD

This invention generally relates to balloon displays, and, more particularly to a balloon display that holds a balloon in a manner that simulates some of the motions of a lighter-than-air balloon.

BACKGROUND OF THE INVENTION

Helium-filled balloons are very popular novelty items, and have become common gifts for birthdays, anniversaries, holidays and other occasions for well-wishing. One of the reasons that helium-filled balloons are so popular, perhaps particularly among children, is that they float and bob and weave with the air currents in due to their lighter-than-air property. The ability to float is absolutely required if a balloon is to be displayed on the end of a string, and millions of balloons on a string are sold every year.

Due to increased demand for helium, it is becoming difficult to offer helium-filled balloons at prices agreeable to potential balloon consumers. For example, while only approximately 8% of the global helium supply is employed in filing balloons, 20% of that supply (and rising) is purchased for use in cooling the magnets of Magnetic Resonance Imaging (MRI) machines. The MRI industry and others industries willing and capable of purchasing helium at high prices are beginning to drive helium prices beyond what the balloon industry can bear. As helium prices increase, helium-filled balloon prices increase, and helium-filled balloon demand decreases. Purveyors of balloons and balloon displays would therefore benefit if a suitable substitute for the classic helium-filled balloon could be provided using cheap ambient air. Because the lighter-than-air properties of a helium-filled balloon are important to the balloon consumer, a suitable substitute should simulate some of the floating, bobbing and weaving properties of lighter-than-air balloons. The present invention thus seeks to address the present difficulties in producing and selling affordable helium-filled balloons by provided a balloon display simulating the motions of a lighter-than-air balloon.

SUMMARY OF THE INVENTION

This invention provides a balloon display that simulates motions of a lighter-than-air balloon. The balloon display includes a balloon holder and an inflated balloon. The balloon holder includes a neck fastening assembly, and the inflated balloon is secured to the balloon holder by the neck fastening assembly. A compression spring balloon support extends upwardly relative to the neck fastening assembly to support a majority of the inflated balloon above the neck fastening assembly. The inflated balloon is secured to the neck fastening assembly and supported by the compression spring balloon support such that the balloon slightly loads the compression spring balloon support and the balloon tends to move up and down, side to side, and front to back as the compression spring balloon support reacts to the load of the balloon.

DESCRIPTION OF THE INVENTION

Figure 1:
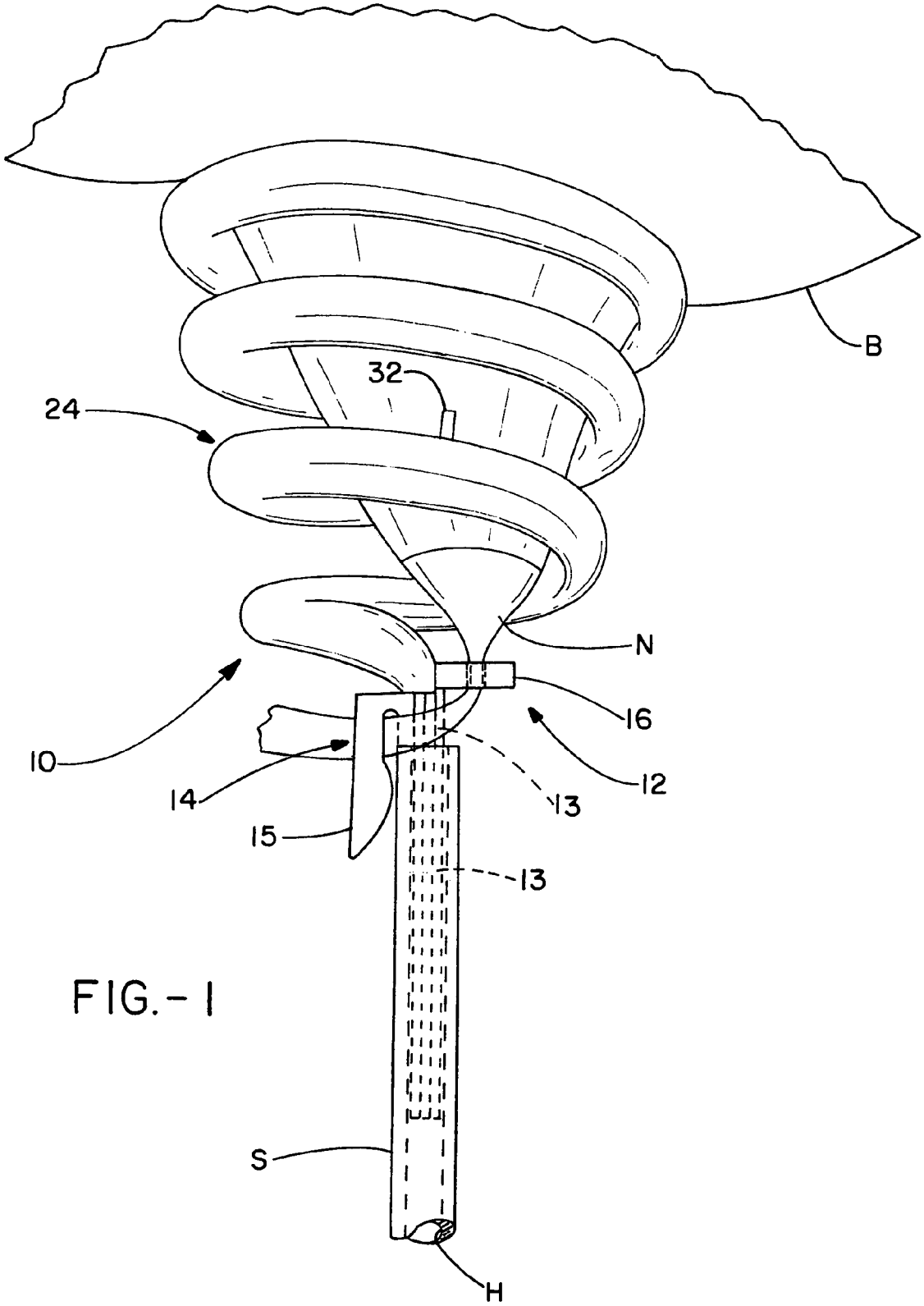
FIG. 1 is a side elevation view of a first embodiment of a balloon display of this invention, the balloon display including a balloon and a balloon holder that is secured to a stick.
Figure 3:
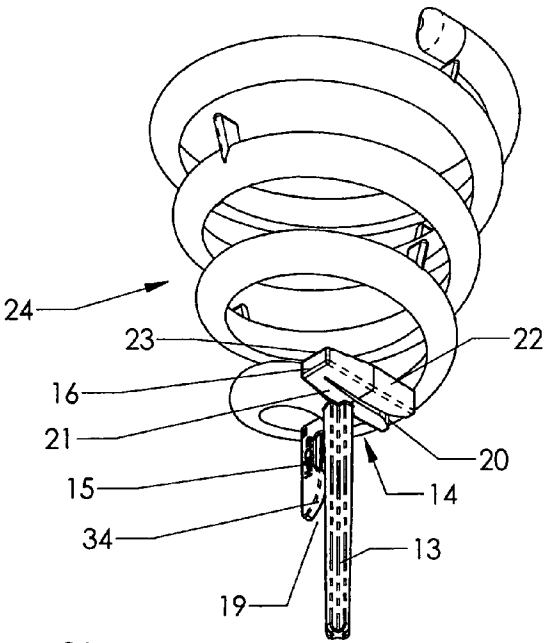
FIG. 3 is a perspective view of the balloon holder portion, provided to show the offset neck grips of that embodiment.
Figure 2:
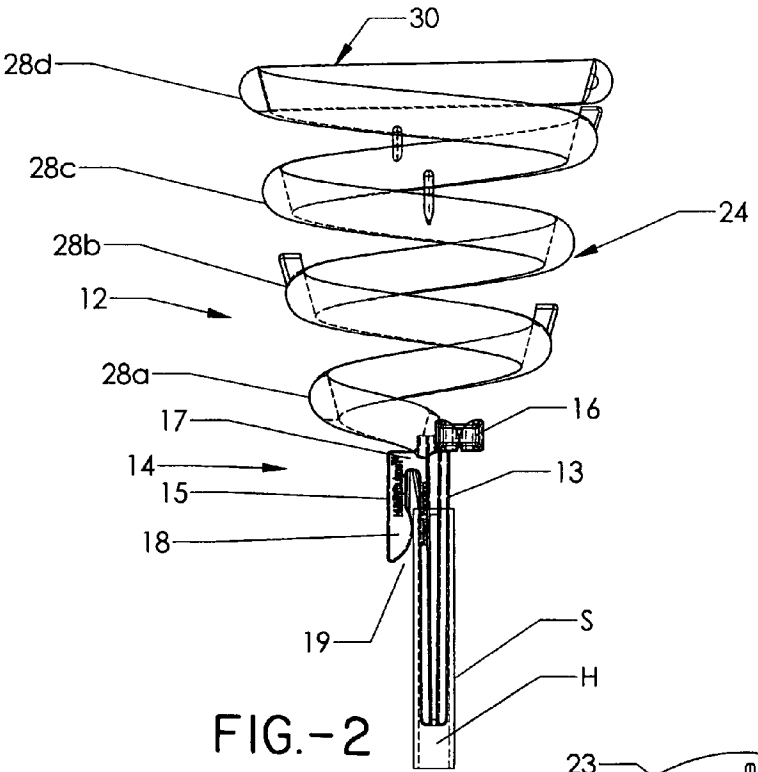
FIG. 2 is a side elevation view of the balloon holder portion of the balloon display of FIG. 1 in accordance with this invention.
Figure 4:
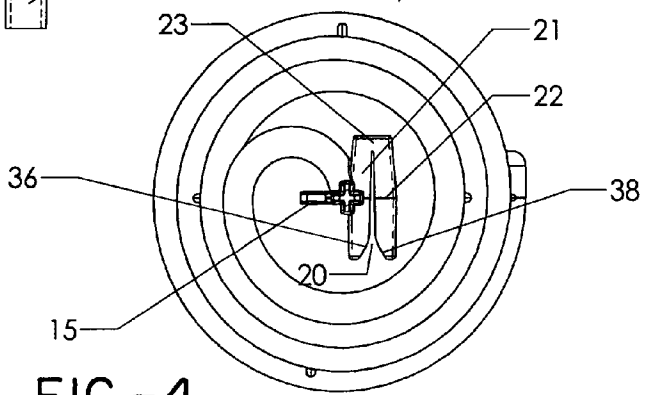
FIG. 4 is a top plan view of the balloon holder of FIG. 2, shown without a balloon B thereon.

With reference to FIGS. 1-4, a first embodiment of a balloon display in accordance with this invention is designated by the numeral 10. This balloon display 10 is in the general form of a balloon B on a stick S, such that the display can be carried around by an individual or set up for a more stationary display, much like a balloon on a string might be carried around or secured to something stationary for display. In this embodiment, a balloon holder 12 is provided at the end of the stick S, and serves to secure the balloon B within the balloon display 10. The balloon holder 12 may be integral with a main support structure, such as that provided by the stick S, or it may be a separate balloon holder element selectively secured to a main support structure, whether provided by a stick or some other base structure. Here, the balloon holder 12 is a separate element from stick S, and provides a stem 13 that frictionally fits within a hollow portion H of the stick S. Thus, the balloon B is secured to the balloon holder 12, which is in turn secured to a stick S to provide the entire balloon on a stick display. As an alternative, the stem 13 could be made sufficiently long to provide the stick as part of the balloon holder, thus making the stick S and balloon holder 12 as one integral unit.

In the embodiment shown, the balloon B is secured to the balloon holder 12 by a neck fastening assembly 14. The neck fastening assembly 14 takes the form of two offset neck grips 15 and 16. It should be appreciated that these offset neck grips 15, 16 are shown only for purposes of providing the currently contemplated fastening assembly for practicing this invention, and any suitable structure can be used to secure the neck of a balloon to the balloon holder. For example, the neck could be fastened to the top part of the stem by a separate clip member or even by tape. Any means that will accomplish the desired result (explained more fully below) can be used, but the offset neck grips 15 and 16 are currently contemplated as the best mode due to ease of use.

The well know foil balloons, which are typically filled with helium in the prior art, are self sealing, and it is therefore usually not necessary to knot the neck of the balloon to seal in the gas. The neck of a well-know latex balloon is usually knotted, but, with appropriately configured neck fastening assembly 14, the knot may be unnecessary. As already mentioned, a separate clip member could be employed as the neck fastening assembly 14, and such a clip could pinch the neck against the stick S or stem 13 so as to prevent gas from leaking from the balloon.

In this particular embodiment, the two neck grips 15 and 16 permit a balloon to be secured to the balloon holder 12 without the need to knot the balloon neck. In relation to stick S, neck grip 15 extends outwardly at radial extension 17 and then downwardly at axial extension 18 to provide a neck slot 19, with a small enough clearance between the outside surface of stick S and the inside surface of axial extension 18 such that a balloon neck N (FIG. 1) may be fed into neck slot 19 and held therein. Preferably, neck N is frictionally pinched by the neck grip 15. With respect to the normal vertical orientation of balloon holder 12, as shown, neck slot 19 lies in a vertical plane. In distinction, neck grip 16 provides a neck slot 20 that lies in a horizontal plane, perpendicular to that of slot 19. It is this orientation that is connoted by the use of the term "offset" to describe the desired offset neck grips 15 and 16, though it should be appreciated that the neck grips 15 and 16 could be offset at different angles and yet still serve the desired function of securing a balloon to the balloon holder 12 in the manner to be described below. Neck grip 16 includes a first leg 21 and a second leg 22 slightly spaced from each other by an extension 23 to define neck slot 20, which, like neck slot 19 provides clearance between first leg 21 and second leg 22 sufficient to receive the neck N of the balloon B. The neck is preferably pinched to help secure and seal it, but, again, this invention is not to be limited to a particular neck fastening assembly 14.

In the embodiment shown, the balloon B is secured to the neck fastening assembly 14 after being pulled through the center of a compression spring balloon support 24 (described more fully below). The neck N of balloon B is first pulled into neck slot 20 of neck grip 16. While this might be sufficient for securing the balloon B to the balloon holder 12, for additional grip, the neck N is then wrapped partially around the stem 13 and pulled into slot 19 of neck grip 15. As seen in the Figures, the axial extension 18 preferably provides a tapered end 34 (FIG. 3) at the entrance of slot 19 to help urge the neck N into the slot 19 when pulled in that direction. Similarly, tapered ends 36, 38 (FIG. 4) are preferably respectively provided on legs 21 and 22 proximate the entrance to slot 20 defined between them. In the case of a self sealing foil balloon, the offset grips 15 and 16 serve to secure the balloon to the balloon holder 12, but, in the case of latex balloons and other balloons that do not self seal, it has been found that these offset grips 15 and 16 can pinch the neck sufficiently to seal the balloon. This is particularly true if the neck slots 19 and 20 are narrow and provide little clearance for the neck N. The neck N is sealed by the pinching of the neck slots 19 and 20, and the wrapping of the neck N partially about the stem 13, and air is retained in the balloon B. If the seal created by neck slots 19 and 20 is not sufficient, it is permissible to tie a knot in neck N, as the knot will not affect the functioning of the balloon display 10.

As mentioned, the balloon B is secured to the balloon holder 12 after being pulled through the center of a compression spring balloon support 24. Compression spring balloon support 24 spirals upwardly from stem 13 in multiple coils 28*a*, 28*b*, 28*c* and 28*d*. Though four coils are shown, more or less could be employed. The uppermost coil 28*d* defines a balloon seat 30, which engages the balloon B at an area surrounding the neck N, and thus, a majority of the inflated balloon B is supported by the compression spring balloon support 24 above the neck fastening assembly 14. Neck N extends through the coils 28*a-d* and is secured to the balloon holder 12, as described above. It should be appreciated that there is no requirement that the balloon support 24 extend from connection to a stick S, as it is also acceptable for the balloon support 24 to extend upwardly from some other structure with which a neck fastening assembly is associated, whether neck fastening assembly 14 or some other fastening means. For example, the balloon support 24 could extend from a stable self-standing structure including a neck fastening assembly or other fastening means.

As the name implies, the compression spring balloon support 24 is created to compress as it is loaded, meaning that the coils 28*a-d* normally remain distanced apart, as shown, and move closer together as a load is placed on the coils. The material of compression spring balloon support 24, the distance between balloon seat 30 and neck fastening assembly 14, and the length of neck N are preferably chosen so that the compression spring balloon support 24 is slightly compressed and loaded when the balloon B rests on balloon seat 30 and its neck N is secured to neck fastening assembly 14. The material of the compression spring balloon support 24 is chosen so that the coils 28*a-d* are affected by the load to move up and down, side to side, and front to back under the load of the balloon B being pulled against the top coil 28*d* defining balloon seat 30. This movement serves to simulate the floating, bobbing and weaving of a lighter-than-air balloon on a string, though the compression spring balloon support 24 may hold a balloon filled with ambient air, and may hold it on the end of a stick or other more rigid structure. The appropriate dimensions (coil thickness, coil separation, number of coils) and appropriate materials (from rigid materials to resilient materials) for creating the desired effect can be mathematically determined, for example through application of Hooke's law and similar laws respecting the functioning of springs of various types and shapes, or, more practically, can be determined experimentally.

Although not required, in this embodiment, each succeeding coil of balloon support 24, from connection at stem 13, at coil 28*a*, to the balloon seat 30 defined by coil 28*d*, extends outwardly to a greater extent than its preceding coil. This is best seen in the top views of FIGS. 4-6. This will save material as well as provide an attractive expanding cone side profile to the balloon support 24. Additionally, the thickness of the material of balloon support 24 is preferably chosen so that the cone-like coils contact one another to prevent a full collapse to a planar structure wherein each coil is side by side. In this way, neighboring coils will be more likely to contact one another as the balloon B bobs and weaves on the balloon support 24. As seen in FIGS. 1-4, spacer protrusions 32 are provided on at least some of the coils 28*a-d* and serve to prevent a complete collapse of one coil into another. In other embodiments, as exemplified in FIGS. 5 and 6, the coils may be shaped and sized such that the do not contact one another as the compression spring balloon support collapses, but instead nest as generally appreciated in those top views. This is a matter of choice, based upon the amount of bouncing, bobbing and weaving desired.

Figure 5:
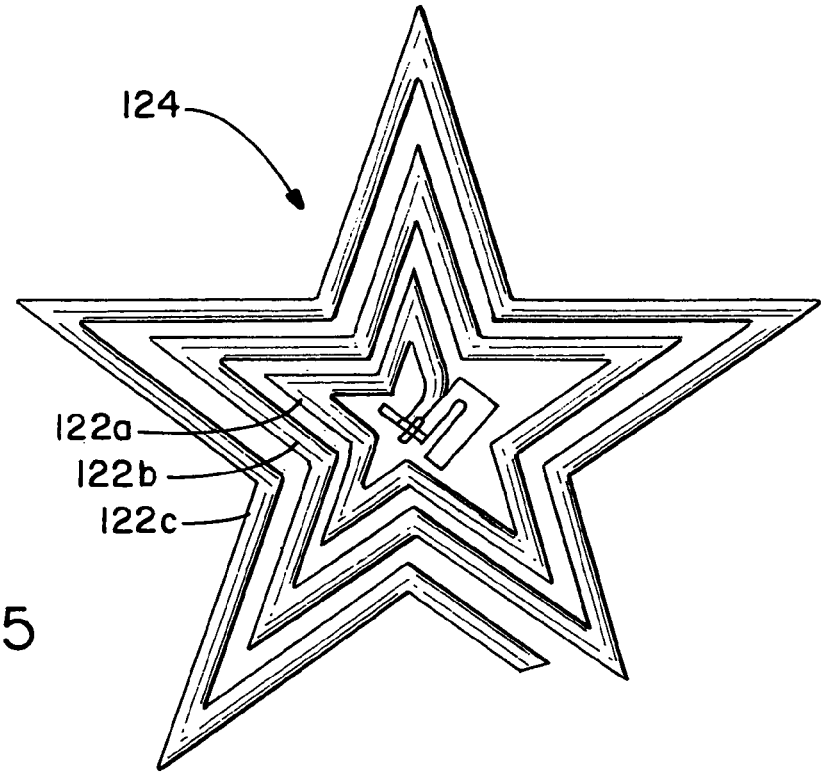
FIG. 5 is a top plan view of an alternative embodiment of a compression spring balloon support portion for balloon displays in accordance with this invention.
Figure 6:
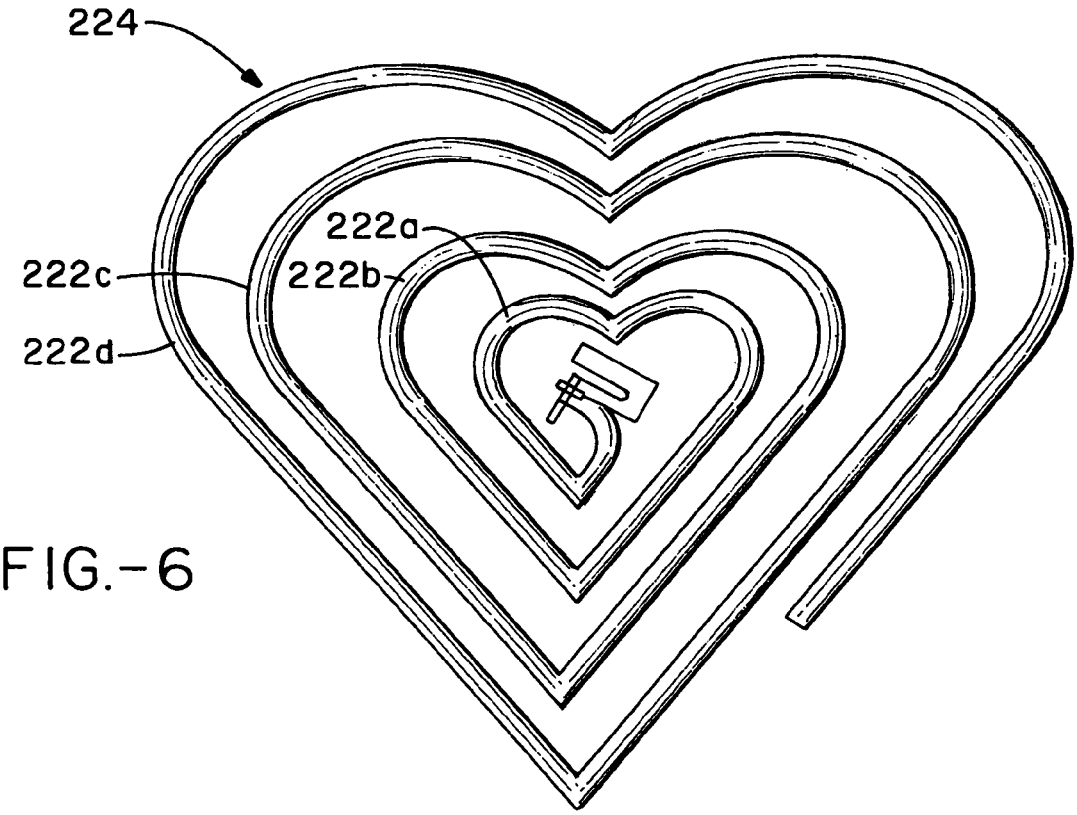
FIG. 6 is a top plan view of another alternative embodiment of a compression spring balloon support portion for balloon displays in accordance with this invention.

In accordance with some embodiments, the coils 22*a-d* need not be circular, and can take more novel shapes such as the star of FIG. 5 (balloon support 124, coils 122*a-c*) or the heart of FIG. 6. (balloon support 224 coils 222*a-d*) These novel shapes will add to the aesthetic of the balloon display, particularly when indicia on the balloon relates to the shape of the coils. For example, a Valentine's Day balloon could be associated with a balloon support 24 having heart-shaped coils.

In present reductions to practice, the compression balloon support 24 is created from plastic materials, but any suitable material can be used. Although four expanding coils are shown, more or less coils could be used to provide a compression spring balloon support. The coils can be uniform or non uniform in diameter. Indeed, other shapes may be determined to produce the desired bobbing and weaving of the balloon secured

We claim:

1. A balloon display that simulates motions of a lighter-than-air balloon comprising:

an inflated balloon; and a balloon holder including:

a neck fastening assembly, said inflated balloon being secured to said balloon holder by said neck fastening assembly;

a compression spring balloon support having multiple coils that expand in diameter as they coil upwardly extending above said neck fastening assembly said multiple coils contacting said balloon above said neck fastening assembly and support a majority of said inflated balloon above said neck fastening assembly, wherein said inflated balloon is secured to said neck fastening assembly and supported by said compression spring balloon support such that said inflated balloon slightly loads said compression spring balloon support and moves up and down, side to side, and front to back as said compression spring balloon support reacts to the load of said inflated balloon.

2. The balloon display of claim 1, wherein said neck fastening assembly includes a first neck grip offset from another neck grip, said first neck grip providing a first neck slot extending in a first plane and said second neck grip providing a second neck slot extending in a second plane offset from said first plane.

3. The balloon display of claim 2, wherein said balloon includes a neck and said balloon holder further includes a stem, and said first neck grip includes a radial extension extending outwardly relative to said stem and an axial extension extending axially relative to said stem to define a neck slot, said balloon being secured to said first neck grip by having a portion of its neck received in said neck slot.

4. The balloon display of claim 3, wherein said second neck grip includes a first leg and second leg spaced from said first leg by an extension to define a second neck slot, said balloon being secured to said second neck grip by having a portion of its neck received in said second neck slot.

5. The balloon display of claim 1, wherein said compression spring coils in a circular shape.

6. The balloon display of claim 1, wherein said compression spring coils in a non-circular shape.

7. The balloon display of claim 1, wherein said balloon holder is carried on the end of a stick, such that the balloon display provides a balloon mounted on the end of a stick.

* * * * *